US005653602A

United States Patent [19]

Yamanashi

[11] Patent Number: 5,653,602

[45] Date of Patent: Aug. 5, 1997

[54] ERRONEOUS CONNECTION PREVENTING STOPPING PLUG

[75] Inventor: Makoto Yamanashi, Shizuoka, Japan

[73] Assignee: Yazaki Corporation, Tokyo, Japan

[21] Appl. No.: 605,757

[22] Filed: Feb. 22, 1996

[30] Foreign Application Priority Data

Feb. 22, 1995 [JP] Japan ..... 7-033735
Feb. 22, 1995 [JP] Japan ..... 7-033886

[51] Int. Cl.[6] ..... H01R 13/44

[52] U.S. Cl. ..... 439/135

[58] Field of Search ..... 439/135, 148, 439/149, 587

[56] References Cited

U.S. PATENT DOCUMENTS

| | | | |
|---|---|---|---|
| 4,426,121 | 1/1984 | Stoewe et al. | 439/148 |
| 4,886,471 | 12/1989 | Fleshman | 439/587 |
| 5,026,295 | 6/1991 | Fong et al. | 439/135 |

FOREIGN PATENT DOCUMENTS 3-74482 7/1991 Japan .

*Primary Examiner*—Neil Abrams
*Assistant Examiner*—T. C. Patel
*Attorney, Agent, or Firm*—Sughrue, Mion, Zinn, Macpeak & Seas

[57] ABSTRACT

A stopping plug includes a body portion to be inserted into a terminal receiving chamber, and a pair of flexible arms formed integrally with the body portion and disposed on inner walls of the terminal receiving chamber which are opposite to each other, a width of the body portion being set to be shorter than a distance between respective outer sides of the pair of flexible arms, the distance between the respective outer sides of the pair of flexible arms being set to be shorter than a distance between the inner walls in opposition to each other of the terminal receiving chamber. The stopping plug includes an abutment wall formed at a front end of the stopping plug in a direction of insertion so as to come into contact with the lance, and other abutment surfaces formed on a rear end of the plug so as to come into contact with guide slopes formed on hole walls of mate-terminal insertion hole formed through the terminal receiving chamber.

20 Claims, 12 Drawing Sheets

ERRONEOUS CONNECTION PREVENTING STOPPING PLUG

BACKGROUND OF THE INVENTION

1. Field of the Invention

The present invention relates to an erroneous connection preventing stopping plug to be inserted into a terminal receiving chamber of a connector housing, in which no terminal has been stored yet, so as to prevent erroneous connection with a mate terminal.

2. Background

For example, in a wire harness 121, a relay box 111, or the like, two or more connectors 122A and 122B, or 112A and 112B, which are the same in kind, are provided adjacently to each other as shown in FIGS. 10 and 11, so that there is a case where a mate connector 123 or a relay 113 is not connected to a certain connector (herein, the connector 122B or 112B) under a condition of circuit design on the destination side. In the case where there is such a useless connector 112B or 112B, an erroneous connection preventing stopping plug (hereinafter abbreviated to "stopping plug") is inserted to a terminal insertion hole 125 in order to prevent the mate connector 123 or the relay 113 from being erroneously connected to the connector 122B or 112B.

As a conventional example of the stopping plug, there is such a stopping plug for water proof as disclosed in JP-U-3-74482. For the sake of preventing erroneous connection, in this case, such a stopping plug 80 as shown in FIG. 12 is inserted into a terminal insertion hole from the front surface side of a connector.

FIG. 12 is a perspective view of the stopping plug 80 for preventing erroneous connection, and FIG. 13 is a side sectional view illustrating the relation between the stopping plug 80 and a connector housing 91 of a connector 90.

Generally, the connector housing 91 has a terminal receiving chamber 94 in which a terminal can be inserted from the rear, and a lance (flexible lock arm) 92 for locking the inserted terminal is provided inside the terminal receiving chamber 94. In addition, a mate-terminal insertion hole 93 is provided in a front wall 95 of the terminal receiving chamber 94, and guide slopes 96*a* and 96*a* are formed so as to spread outward in the front upper and lower portions of the hole wall of the mate-terminal insertion hole 93. The upper and lower guide slopes 96*a* and 96*a* guide a male mate-terminal to the mate-terminal insertion hole 93 when the male mate-terminal is to be inserted.

The stopping plug 80 has a plate-like body portion 81 which is to be inserted to the mate-terminal insertion hole 93 of the connector housing 91, and a head portion 82 provided at the rear end in the insertion direction thereof. A detachment preventing projection 83 which is to hit on a rear surface 97 of the front wall 95 of the connector housing 91 when the body portion 81 is inserted into the mate-terminal insertion hole 93, to thereby prevent the stopping plug 80 from coming off (in the direction opposite to the direction of insertion) is provided on the upper surface of the body portion 81. In addition, abutment surfaces 85 which are to abut on the guide slopes 96*a* and 96*a* of the connector housing 91 so as to prevent the stopping plug 80 from being inserted more are provided on the front upper and lower portions of the head portion 82.

When the terminal insertion hole 93 is blocked by this stopping plug 80, the body portion 81 of the stopping plug 80 is pushed into the terminal insertion hole 93 as shown by the arrow in FIG. 13. Then, the transformation of the connector housing 91 or the stopping plug 80 makes the detachment preventing projection 83 pass the terminal insertion hole 93 and enter the terminal receiving chamber 94 as shown in FIG. 14. Then, the abutment surfaces 85 provided in the head portion 82 abut against the guide slopes 96*a* and 96*a* of the terminal insertion hole 93 of the connector housing 91 so that the plug 80 stops there. As for the detachment direction, the detachment preventing projection 83 of the stopping plug 80 hits on the rear surface of the front wall 95 of the terminal receiving chamber 94 so as to prevent the detachment of the stopping plug 80.

Therefore, even if a mate connector or relay is fitted to this connector 90 erroneously, a male terminal of the mate connector abuts on the stopping plug 80 so that the male terminal cannot be inserted. Accordingly, it is possible to prevent erroneous connection. At this time, it is not necessary to insert stopping plugs to all the terminal insertion holes of the connector, and it is possible to prevent erroneous connection if a stopping plug is inserted to one of the terminal insertion holes.

In the conventional stopping plug 80, the rear end abutment surfaces 85 and 85 abut on the guide slopes 96*a* and 96*a* of the terminal insertion hole 93 of the connector housing 91 so as to prevent the stopping plug from being inserted more as shown in FIG. 15. However, since the connector housing 91 and the stopping plug 80 are made of resin and are locked by making the slopes abut on each other, there is a fear that the stopping plug 80 sinks down inside the connector housing 91 so as to make connection with a mate-connector 90B erroneously if an excessively strong pushing force is added to the stopping plug 80 by a male terminal 99 of the mate connector 90B as shown by the arrow (a).

FIGS. 22A to 26 show another conventional example illustrating the relation between a stopping plug 1 and a connector housing 11.

In FIGS. 22A and 22B, in the stopping plug 1, projections 7 and 7 having slope surfaces 5 and 5 are formed on a body portion 3 on its opposite side surfaces so as to axially extend from one side end portions to intermediate portions, respectively. In addition, a cover portion (head portion) 9 is formed on the other side of the stopping plug 1.

On the other hand, in a terminal receiving chamber 13 of the connector housing 11 in which the stopping plug 1 is to be inserted, front walls 17 and 19 are provided in one-side opening 15 to project from the edge portion as shown in FIGS. 23A, 23B and 24. A mate terminal is to be inserted into the terminal receiving chamber 13 between these front walls 17 and 19. In addition, this terminal receiving chamber 13 is set so that the inner width L1 thereof is longer than the width L2 of the stopping plug 1, and that the height L3 of the opening portion is longer than the thickness L4 of the stopping plug 1 as shown in FIGS. 22A, 22B, 23A and 23B. A flexible lock arm 21 is provided in this terminal receiving chamber 13 so as to project from the inner wall of the latter. This lock arm 21 is engageable with a terminal received in the terminal receiving chamber 13 thereby prevent the terminal from coming-off.

FIGS. 25A, 25B and 26 show the end surface of another terminal receiving chamber 25 in which a terminal hitting preventing wall 23 is formed on the opening edge portion. In this terminal receiving chamber 25, the width L5 of its opening portion is set to be shorter than the width L2 of the stopping plug 1 (FIG. 22A). In addition, the height L6 of the opening portion of the terminal receiving chamber 25 is set to be longer than the thickness L4 of the stopping plug 1 (FIG. 22B).

The stopping plug 1 is inserted from the one-side opening 15 of the terminal receiving chamber 13 to the inside as shown in FIGS. 23A, 23B and 24 so as to be installed in the terminal receiving chamber 13 through engagement of the projection 7 with the terminal stopping wall 17 at the opening edge portion of the terminal receiving chamber 13. Consequently, it is possible to prevent such erroneous connection that a mate terminal is erroneously connected into the terminal receiving chamber in which no terminal has been received yet.

If the width of the stopping plug 1 is set to be substantially equal to the width of the terminal receiving chamber 13, however, when the stopping plug 1 is inserted into the terminal receiving chamber 13 in which no terminal has been received yet, the insertion force becomes so large that the workability of insertion gets much worse. If the width of the stopping plug 1 is therefore set to be shorter than the width of the terminal receiving chamber 13 for the sake of easy insertion, there is a problem that looseness arises to generate abnormal sound.

In addition, when the stopping plug 1 is inserted into the terminal receiving chamber 25, it is impossible to insert the stopping plug 1 because the terminal hitting preventing wall 23 reduces the width of the opening of the terminal receiving chamber 25. If the width of the stopping plug 1 is set to be short enough to be inserted into the terminal receiving chamber 25, looseness arises when the stopping plug 1 has been inserted in the terminal receiving chamber 13.

SUMMARY OF THE INVENTION

It is an object of the present invention to provide an erroneous connection preventing stopping plug to be inserted into any of a plurality of kinds of terminal receiving chambers different in the opening widths from each other in a state where no terminal is received in the terminals chamber, the stopping plug being improved in the workability of insertion into the terminal receiving chamber in which no terminal is received, and being installed with reduced looseness.

Further, it is another object of the present invention to provide an erroneous connection preventing stopping plug in which the strength against pushing is increased so that erroneous connection can be prevented surely.

In order to achieve the above object, according to the first aspect of the present invention, provided is a stopping plug which is to be externally inserted into a mate-terminal insertion hole of a connector housing to close the mate-terminal insertion hole, the connector housing including a terminal receiving chamber to which a terminal can be inserted from a rear side of the terminal chamber, a lance provided inside the terminal chamber for locking the terminal, the mate-terminal insertion hole formed through a front wall of the terminal receiving chamber, and guide slopes formed on hole walls of the mate-terminal insertion hole so as to be spread outward to thereby guide the mate-terminal into the mate-terminal insertion hole, wherein the stopping plug includes an abutment wall formed on a front end of the plug in a direction of insertion thereof so as to come into contact with the lance, and abutment surfaces formed on a rear end of the plug so as to come into contact with the guide slopes.

According to the second aspect of the present invention, in the stopping plug according to the first aspect of the invention, the plug further includes flexible arms formed on opposite sides of the plug so as to come into slide-contact with inner walls of the terminal receiving chamber.

According to the third aspect of the present invention, provided is a stopping plug to be inserted into an empty one of terminal receiving chambers where no terminal is inserted for preventing a mate terminal from erroneously inserting into the empty terminal receiving chamber where no terminal is received, the terminal receiving chambers being different in width of opening portions from each other, wherein the stopping plug includes a body portion to be inserted into the terminal receiving chamber, and a pair of flexible arms formed integrally with the body portion and disposed on inner walls of the terminal receiving chamber which are opposite to each other, a width of the body portion being set to be shorter than a distance between respective outer sides of the pair of flexible arms, the distance between the respective outer sides of the pair of flexible arms being set to be shorter than a distance between the inner walls in opposition to each other of the terminal receiving chamber.

According to the fourth aspect of the present invention, in the stopping plug according to the third aspect of the invention, each of the pair of flexible arms has a slope surface which is inwardly inclined toward its top end portion.

According to the fifth aspect of the present invention, in the above mentioned stopping plug according to the third or fourth aspect of the invention, the distance between the respective outer sides of the pair of flexible arms is set to be larger than the distance between the inner walls in opposition to each other of the terminal receiving chamber.

According to the sixth aspect of the present invention, in the above mentioned stopping plug according to any one of the third to fifth aspects of the invention, a cover portion is formed integrally with the body portion so that the cover portion closes the opening portion of the terminal receiving chamber in a state where the body portion is inserted in the terminal receiving chamber.

According to the seventh aspect of the present invention, in the above mentioned stopping plug according to any one of the third to sixth aspects of the invention, the body portion has an abutment wall which comes into contact with a flexible lock arm projected from an inner wall of the terminal receiving chamber so as to be engageable with a terminal which is to be inserted into the terminal receiving chamber.

As described above, according to the first aspect of the present invention, when the stopping plug is inserted into the terminal insertion hole of the connector housing, the abutment wall formed on the front end of the plug comes to abut against the lance and the abutment surfaces formed on rear end of the plug come into contact with the guide slopes of the hole walls of the terminal insertion hole.

According to the second aspect of the present invention, since the flexible arms formed on opposite sides of the plug come into slide-contact with the inner walls of the terminal receiving chamber, no deviation due to vibration, or the like, is caused.

According to the third aspect of the present invention, when the body portion of the stopping plug is inserted into an empty terminal receiving chamber where no terminal is received, the pair of flexible arms come to position on the inner walls of the terminal receiving chamber which are opposite to each other, so that the stopping plug can be installed in the empty terminal receiving chamber where no terminal is received in a condition that looseness is suppressed to be as less as possible. Further, even in a case where a terminal hitting preventing wall is provided at the opening portion of the terminal receiving chamber so that the width of the opening portion is made narrow, the stopping plug can be inserted in a condition that the flexible arms are elastically bent.

According to the fourth aspect of the present invention, if the body portion is pushed into the terminal receiving chamber when the body portion is installed in the empty terminal receiving chamber where no terminal is received, the slope surfaces of the flexible arms abut against the edges of the opening portions of the terminal receiving chamber so that the flexible arms elastically bent inward. If the body portion is pushed into the terminal receiving chamber in such a condition that the flexible arms are elastically bent, the stopping plug body can be smoothly installed into the terminal receiving chamber.

According to the fifth aspect of the present invention, since the distance between the respective outer sides of the pair of flexible arms is set to be larger than the distance between the inner walls in opposition to each other of the terminal receiving chamber, the stopping plug can be received in the terminal receiving chamber without any looseness.

According to the sixth aspect of the present invention, the cover portion closes the opening portion of the terminal receiving chamber when the body portion is inserted into the terminal receiving chamber. Thus, a mate-terminal can be prevented from being inserted into the empty terminal chamber in which no terminal is received.

According to the seventh aspect of the present invention, when the body portion is inserted into the terminal receiving chamber, the abutment wall comes into contact with the flexible lock arm so that the insertion position is defined. Accordingly, even if the body portion is pushed erroneously by a mate terminal, the body portion is prevented from coming into deeper in the terminal receiving chamber.

BRIEF DESCRIPTION OF THE DRAWINGS

FIGS. 2A–2C show the stopping plug according to the first embodiment of the present invention; in which FIG. 2A is a plan view, FIG. 2B is a side view, and FIG. 2C is a rear view;

FIGS. 17A and 17B show the stopping plug according to the second embodiment of the present invention; in which FIG. 17A is a plan view, and FIG. 17B is a side view;

FIGS. 22A and 22B show of a stopping plug of another conventional example; in which FIG. 22A is a plan view, and FIG. 22B is a side view;

FIGS. 23A and 23B show the state where the conventional stopping plug shown in FIGS. 22A and 22B has been installed in a terminal receiving chamber which has no terminal hitting preventing wall; in which FIG. 23A is a sectional view, and FIG. 23B is a front view;

FIGS. 25A and 25B show the inside of a terminal receiving chamber having a terminal hitting preventing wall; in which FIG. 25A is a sectional view, and FIG. 25B is a front view.

DETAILED DESCRIPTION OF THE PREFERRED EMBODIMENT

Figure 1:
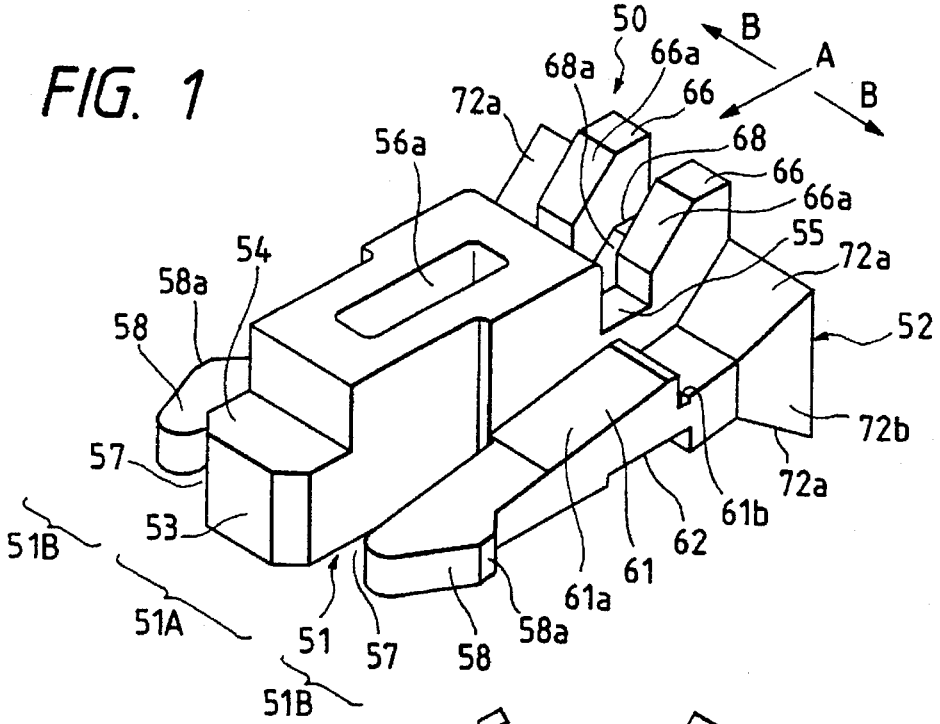
FIG. 1 is a perspective view illustrating an erroneous connection preventing stopping plug according to a first embodiment of the present invention.
Figure 3:
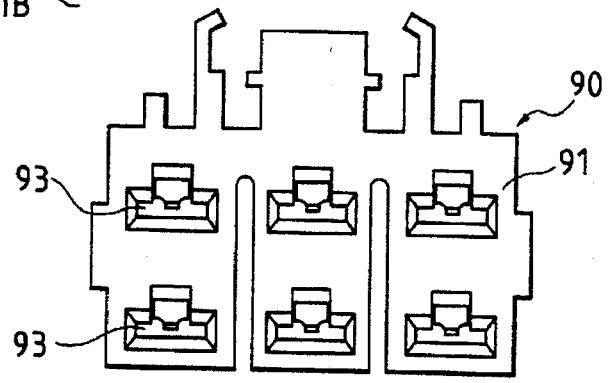
FIG. 3 is a front view of a connector housing, a target to which the stopping plug of the first embodiment of the present invention is to be inserted.
Figure 4:
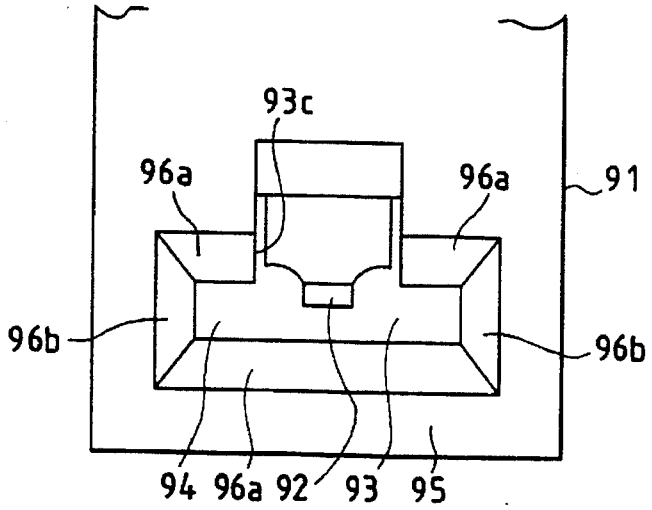
FIG. 4 is an enlarged diagram of a terminal insertion hole of the connector housing in FIG. 3.
Figure 2A:
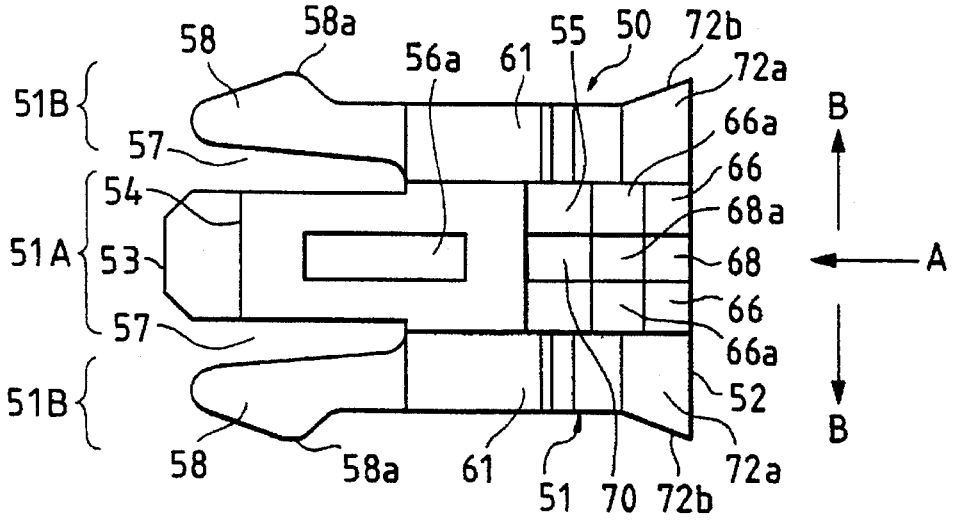
Figure 2B:
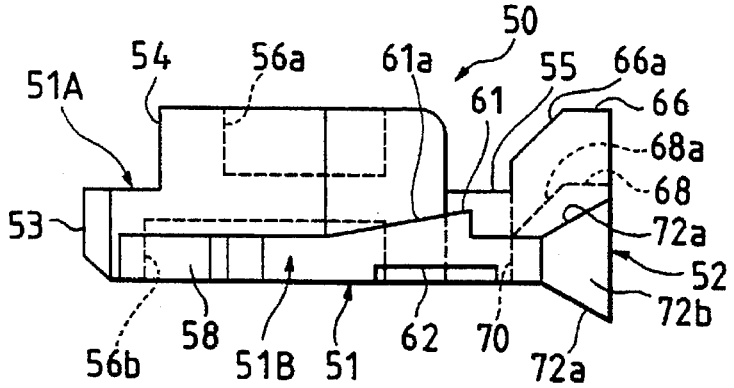
Figure 2C:
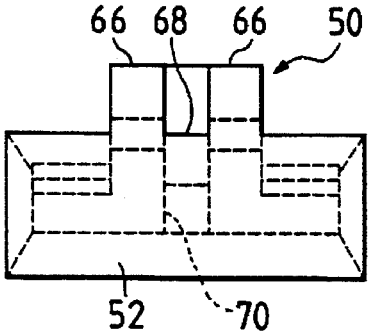

FIG. 1 is a perspective view of a stopping plug 50 according to a first embodiment; FIGS. 2A–2C are plan, side and rear views of the stopping plug 50; FIG. 3 is a front view of a connector 90 which is a target to which the stopping plug 50 in the first embodiment is to be inserted; FIG. 4 is a partially enlarged view of FIG. 3; and FIG. 5 is a side view illustrating the relationship between the stopping plug 50 and a connector housing 91.

The connector 90 in this case is a disposable connector, in which at least one of terminal receiving chambers has not received a female terminal. FIG. 4 is a front view of a terminal insertion hole 93 of such a terminal receiving chamber 94 which has not received a female terminal.

First, the structure of the connector housing 91 of the connector 90 will be described with reference to FIGS. 4 and 5.

Figure 5:
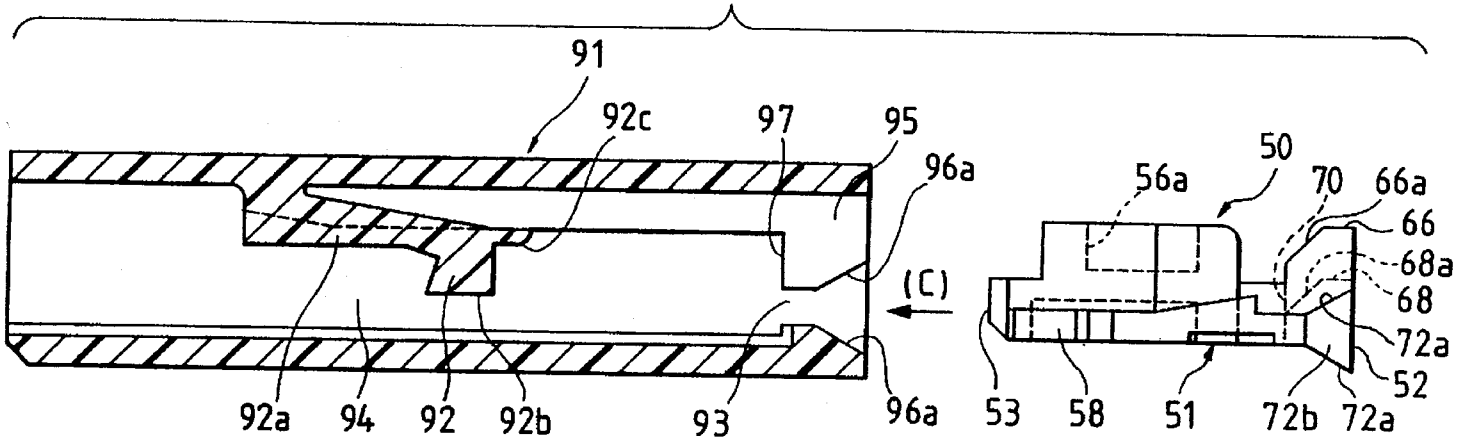
FIG. 5 is a side sectional view illustrating the relation between the stopping plug of the first embodiment of the present invention and the connector housing.

The connector housing 91 is made by a resin molded part, having a terminal receiving chamber 94 to which a terminal (in this case, a female terminal) can be inserted from the rear, a lance 92 provided inside the terminal receiving chamber 94, a mate-terminal insertion hole 93 provided in a front wall 95 of the terminal receiving chamber 94, and guide slopes 96*a* and 96*b* formed in the hole wall of the mate-terminal insertion hole 93 so as to be expanded outside, as shown in FIG. 5.

The lance 92 has a flexible arm 92*a* extending forward in the space of the terminal receiving chamber 94, a lock wall portion 92*b* provided on the top end of the flexible arm portion 92*a* so as to be engageable with a terminal, and a projection 92*c* projecting from the front surface of the lock wall portion 92*b*. As shown in FIG. 4, upper and lower guide slopes 96*a* and 96*a*, and left and right guide slopes 96*b* and 96*b* are provided in the hole wall of the terminal insertion hole 93, and a rectangular notch 93*c* is formed at the center of the upper edge of the hole wall. The lance 92 is disposed beyond the notch 93*c*.

Next, the stopping plug 50 will be described with reference to FIGS. 1, 2A–2C and 5.

The stopping plug 50 includes a body portion 51 which will be inserted into the terminal insertion hole 93, and a head portion 52 provided at the rear end in the insertion direction, being formed as an integrally resin molded part.

As shown in FIG. 1, assuming that the insertion direction of the stopping plug 50 is A, and that the width direction is B, the body portion 51 has a square-pillar-like central insertion portion 51A disposed at the center in the width direction B, and plate-like side insertion portions 51B and 51B disposed in either side thereof. The central insertion portion 51A is a portion which will be inserted to the center (the portion having the notch 93*c*) of the terminal insertion hole 93 shown in FIG. 4, and the side insertion portions 51B are portions which will inserted to the left and right sides (opposite sides of the portion having the notch 93*c*) of the terminal insertion hole 93.

When the stopping plug 50 is inserted into the terminal insertion hole 93, the top end of the central insertion portion 51A will be an abutment wall 53 abutting on the lock wall portion 92*b* of the lance 92. A notch portion 54 for receiving the projection 92*c* of the lance 92 is provided in the upper portion of this abutment wall 53. In addition, a rear concave portion 55 which is rectangular in the view from the side is provided between the rear end in the insertion direction of the central insertion portion 51A and the head portion 52. In addition, holes 56*a* and 56*b* for weight reduction are provided in the upper and lower surfaces of the central insertion portion 51A.

In addition, the front-half portion of each of the side insertion portions 51B is separated from the central insertion portion 51A by a slit 57, and the separated portion is a flexible arm 58 having flexibility in the width direction B. A sliding contact surface 58*a* bent in a convex is provided in the outer surface of the flexible arm 58, and a small gap is formed between this sliding contact surface 58*a* and the inner wall 94*a* of the terminal receiving chamber 94 (see FIG. 6). Then, the sliding contact surface 58*a* can slide on the inner wall 94*a* when the sliding contact surface 58*a* contacts therewith at the time of insertion of the stopping plug 50. If there is no gap between the sliding contact surface 58*a* and the inner wall 94*a*, the sliding contact surface 58*a* may be designed to always slide thereon at the time of insertion of the stopping plug 50.

A detachment preventing projection 61 is provided on the upper surface of each of the side insertion portions 51B. The detachment preventing projection 61 has a slope 61*a* with the inclination increasing from the position of the rear end of the flexible arm 58 to the back, and a vertical lock surface 61*b* coupled with the rear end of the slope 61*a*. Then, the detachment preventing projection 61 is designed to prevent the stopping plug 50 from being detached in the direction opposite to the insertion direction since the lock surface 61*b* abuts on the rear surface of the front wall 95 of the terminal receiving chamber 94 of the connector housing 91. In addition, a notch concave portion 62 for making the detachment preventing projection 61 thin is provided in the lower surface thereof.

Next, the structure of the head portion 52 will be described.

The head portion 52 has a pair of parallel convex walls 66 and 66 projecting upward at the center in the width direction B, and has an intermediate concave portion 68 between the pair of convex walls 66 and 66. The front sides of the convex walls 66 and 66 are downward inclined surfaces 66*a* and 66*a*, coupled with the rear concave portion 55 at the rear end of the central insertion portion 51A. In addition, the front side of the intermediate concave portion 68 is also a downward inclined surface 68*a*, coupled with a through hole 70 provided at the center of the rear concave portion 55. In FIG. 2A, the portion of the through hole 70 is designated by hatching.

In addition, abutment surfaces 72*a* are provided outside the pair of convex walls 66 and 66 respectively. The head portion 52 other than the pair of convex walls 66 and 66 and the intermediate concave portion 68 is designed to abut on the upper, lower, left and right guide slopes 96*a* and 96*b* of the connector housing 91 when the stopping plug 50 is inserted into the terminal insertion hole 93.

The operation will be described below.

Figure 6:
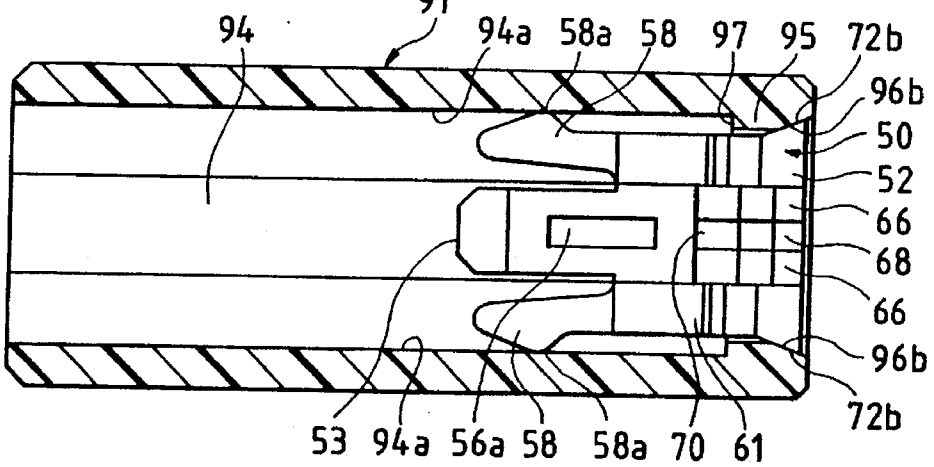
FIG. 6 is a main portion plan sectional view of a connector to which the stopping plug of the first embodiment of the present invention has been inserted.
Figure 7:
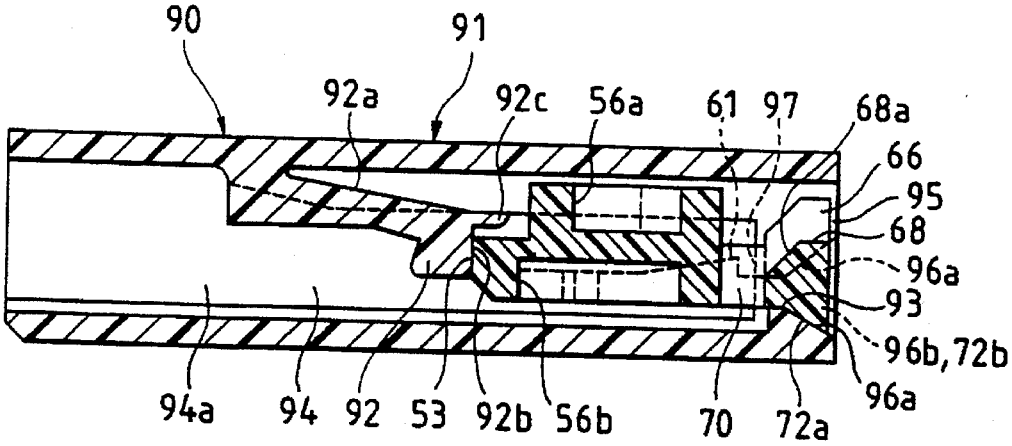
FIG. 7 is a main portion plan sectional view of the connector to which the stopping plug of the first embodiment of the present invention has been inserted.
Figure 8:
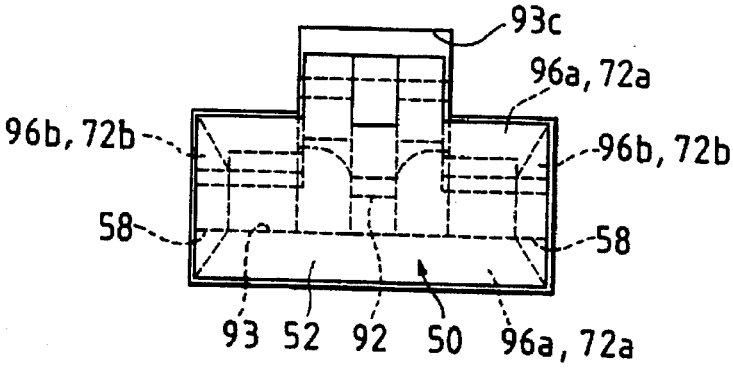
FIG. 8 is a front view of the connector to which the stopping plug of the first embodiment of the present invention has been inserted.

When the stopping plug 50 is inserted into the terminal insertion hole 93 of the connector housing 91 as shown in the arrow (c) of FIG. 5, the abutment wall 53 at the front end of the stopping plug 50 abuts on the lock wall portion 92*b* of the lance 92, and the abutment surfaces 72*a* and 72*b* at the rear end of the stopping plug 50 abut on the guide slopes 96*a* and 96*b* of the hole wall of the terminal insertion hole 93 as shown in FIGS. 6, 7 and 8. Therefore, the stopping plug 50 is stopped by the lance 92 as well as the guide slopes 96*a* and 96*b*, so that the strength against pushing is increased. Accordingly, even if the stopping plug 50 is pushed in by an excessive force, there is no fear that the stopping plug 50 sinks down inside the connector housing 91, so that erroneous connection of the connector can be prevented surely. In addition, since the flexible arm 58 in the side portion slides on the inner wall 94*a* of the terminal receiving chamber 94 in the state of insertion, there arises no deviation caused by vibration or the like, so that it is possible to prevent looseness. Then, the detachment preventing projection 61 has an effect similar to that mentioned above.

Figure 9:
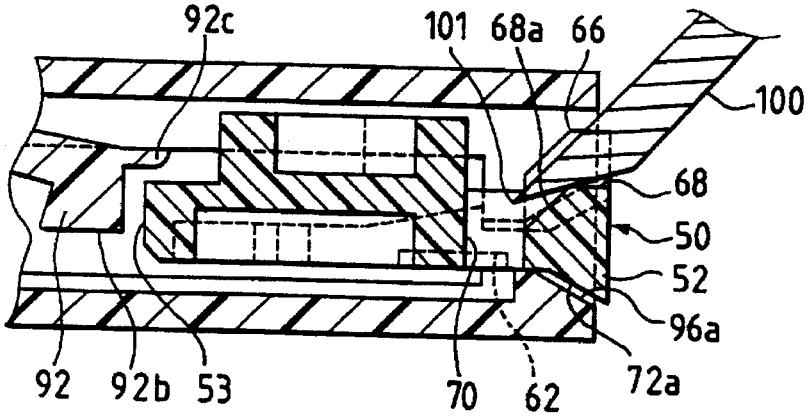
FIG. 9 is a side sectional view illustrating the state where the stopping plug of the first embodiment of the present invention is going to be detached from the connector.
Figure 10:
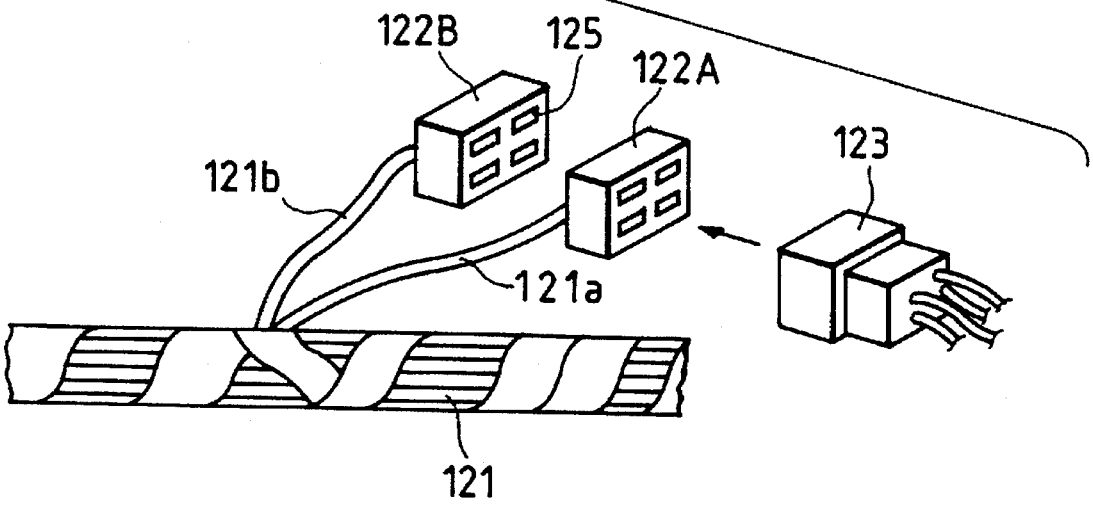
FIG. 10 is a perspective view illustrating an example of target to which this kind of stopping plug is to be used.
Figure 11:
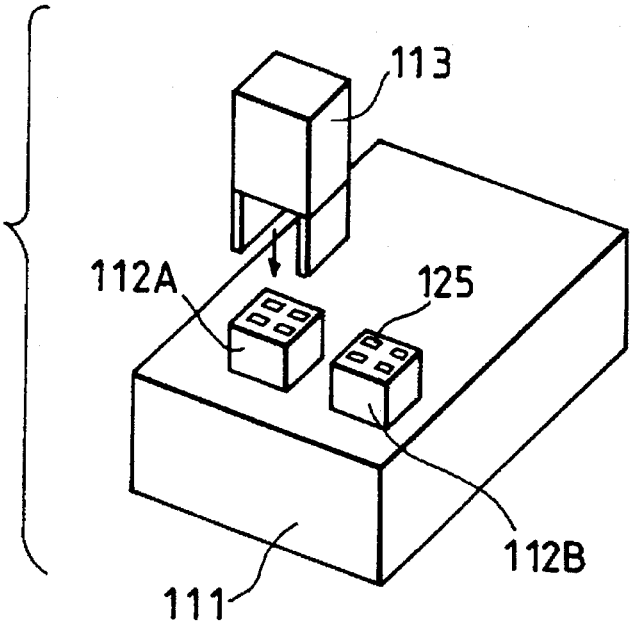
FIG. 11 is a perspective view illustrating another example of target to which this kind of stopping plug is to be used.
Figure 12:
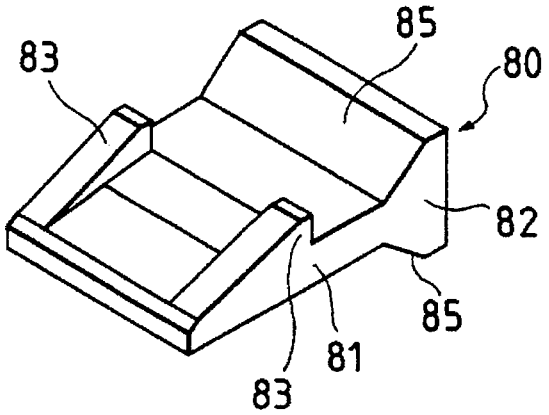
FIG. 12 (PRIOR ART)
FIG. 12 is a perspective view illustrating a conventional stopping plug.
Figure 13:
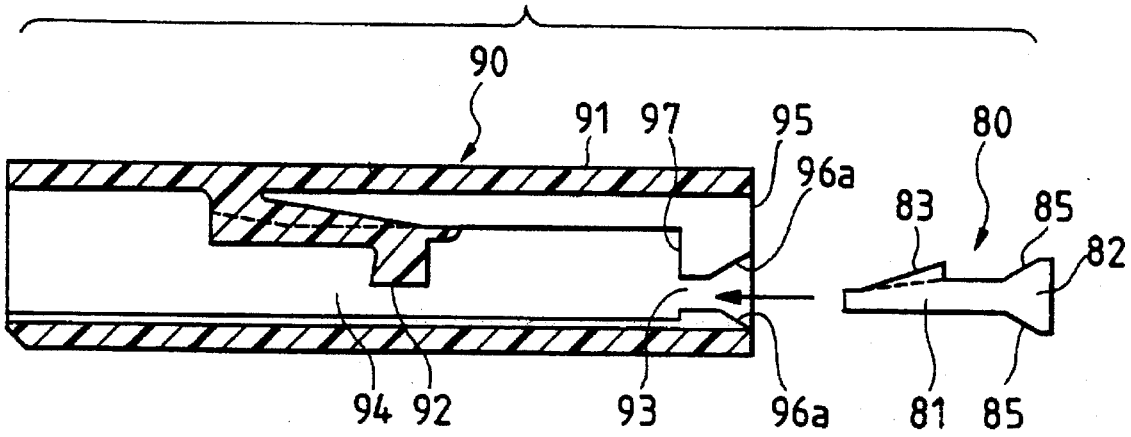
FIG. 13 (PRIOR ART)
FIG. 13 is a side sectional view illustrating the relation between the conventional stopping plug and a connector housing which is a insertion target of the former.
Figure 14:
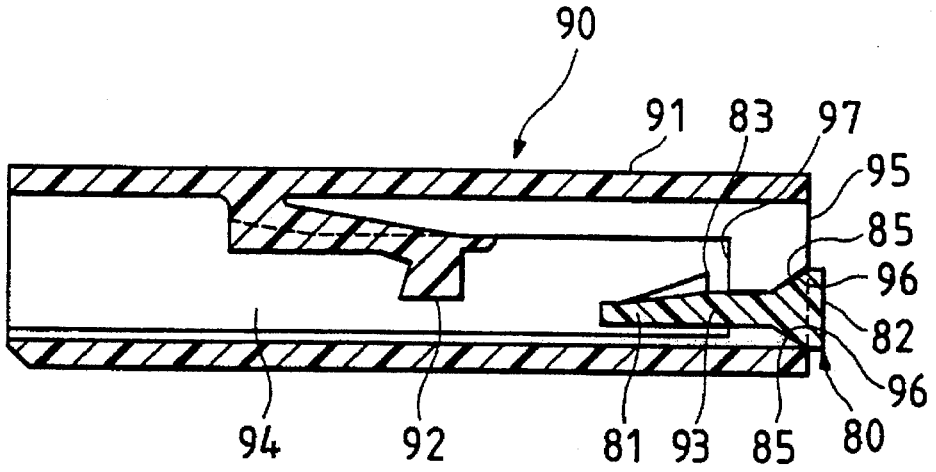
FIG. 14 (PRIOR ART)
FIG. 14 is a side sectional view of a connector to which the conventional stopping plug has been inserted.
Figure 15:
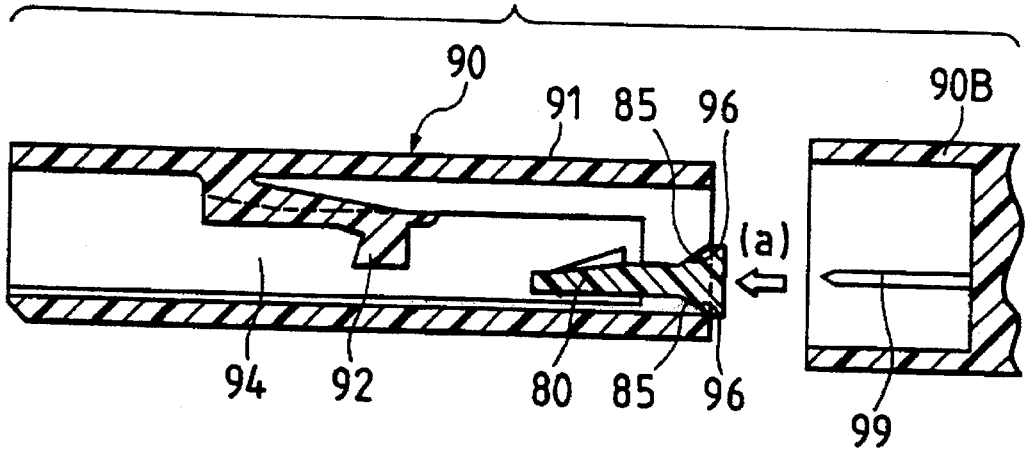
FIG. 15 (PRIOR ART)
FIG. 15 is a side sectional view used for description of problems belonging to the conventional stopping plug.

In addition, when there arises necessity to detach the stopping plug 50, a sharp top end 101 of a jig 100 is inserted into the intermediate concave portion 68 provided in the head portion 52 of the stopping plug 50, and the top end 101 is inserted into the through hole 70 from the inclined surface 68*a* of the intermediate concave portion 68, as shown in FIG. 9. Then, the stopping plug 50 is lifted up in the state where the top end 101 is inserted into the through hole 70. Consequently, the stopping plug 50 can be detached from the front side of the connector. Therefore, it is not necessary to push out the stopping plug 50 with a jig inserted from the back of the connector housing 91 so as to avoid the lance 92. Accordingly, there is no fear that the lance 92 is injured.

Next, a second embodiment is related to measures of a stopping plug and a connector housing of the present invention, which will be described below with reference to FIGS. 16 to 21.

Figure 16:
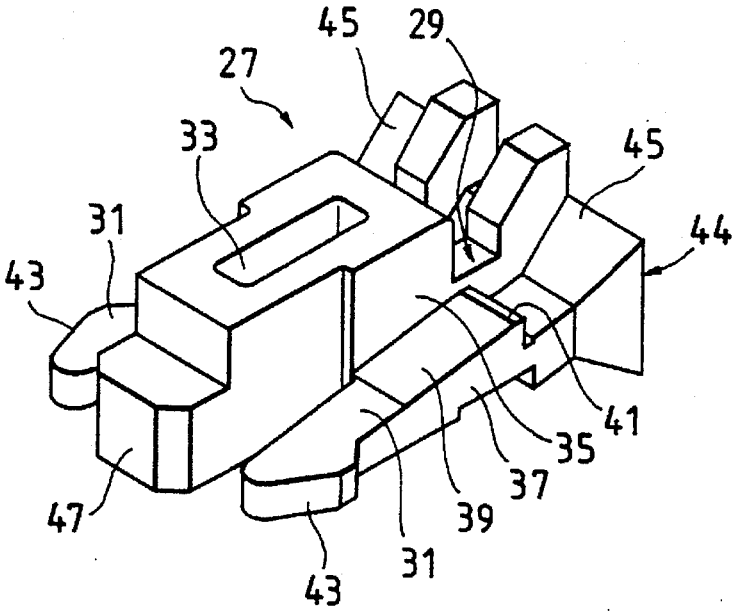
FIG. 16 is a perspective view illustrating an erroneous connection preventing stopping plug according to a second embodiment of the present invention.
Figure 17A:
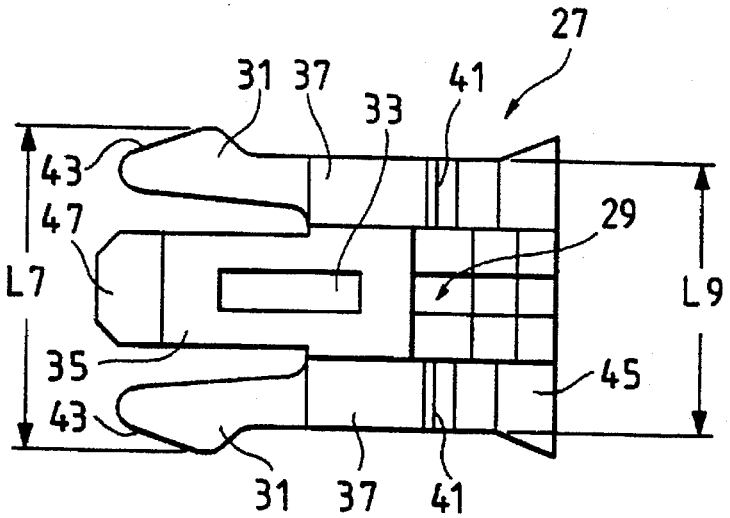

FIG. 16 is a perspective view illustrating a stopping plug 27. FIG. 17A is a plan view illustrating the stopping plug 27, and FIG. 17B is a side view illustrating the stopping plug 27.

Figure 17B:
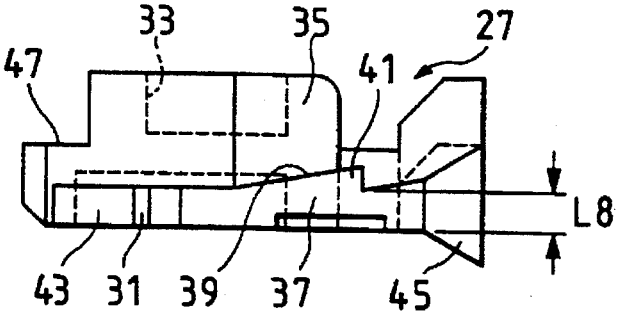

As shown in FIGS. 16, 17A and 17B, the stopping plug 27 includes a body portion 29, and a pair of flexible arms 31 and 31 formed integrally with this body portion 29. In the body portion 29, plate portions 37 and 37 are provided so as to extend from the opposite sides of a base portion 35 in which a hole 33 is formed in its intermediate portion. Detachment preventing projections 41 and 41 having slopes 39 and 39 are formed on these plate portions 37 and 37 respectively. Flexible arms 31 and 31 are provided so as to extend along the base portion 35 from one-end sides of these projections 41 and 41. Projecting outward from the plate portions 37 and 37 once, the flexible arms 31 and 31 are made narrower gradually inward so that slopes 43 and 43 are formed so as to be inclined inward. Distance L7 between the outsides of the flexible arms 31 and 31 is set equal to or a little shorter than the width L1 (see FIG. 18) between opposite inner walls of a terminal receiving chamber 13. Therefore, when the stopping plug 27 is inserted into the terminal receiving chamber 13, the flexible arms 31 and 31 touch the opposite inner walls 13*a* and 13*b* of the terminal receiving chamber 13, or has a slight distance thereto. Of course, the distance L7 between the outsides of the flexible arms 31 and 31 may be set larger than the width L1 between the opposite inner walls of the terminal receiving chamber 13. In addition, the thickness L8 of the plate portion 37 is set to be shorter than the height L3 or L6 of the opening portion of the terminal receiving chamber 13 or a terminal receiving chamber 25. Further, the width L9 of the body portion 29 is set to be shorter than the width L1 between the opposite inner walls 13*a* and 13*b* of the terminal receiving chamber 13.

In addition, cover portions 45 and 45 are formed on a head portion 44. The cover portions 45 and 45 coupling the other end sides of the plate portions 37 and 37 with each other are formed on the other ends of the plate portions 37 and 37, respectively. The size of this head portion 44 is set to be a little smaller than the size of the opening of the terminal receiving chamber 13 to which the stopping plug 27 is inserted.

In addition, an abutment wall 47 is formed in the top end portion of the base portion 35 between the flexible arms 31 and 31. This abutment wall 47 is made to engage with a lock wall portion 22 of a flexible lock arm (lance) 21 provided in the terminal receiving chamber 13 so as to project inward.

Figure 18:
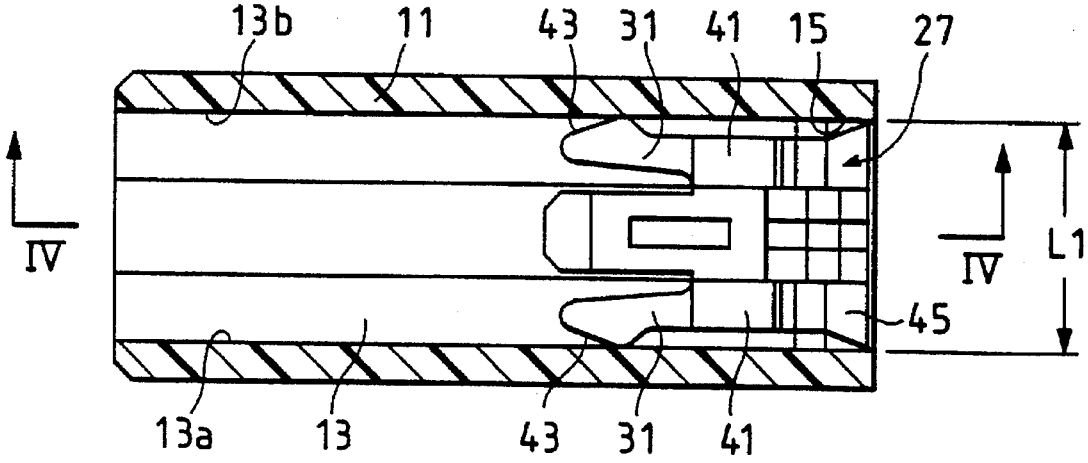
FIG. 18 is a sectional view illustrating the state where a stopping plug has been installed in a terminal receiving chamber which has no terminal hitting preventing wall.
Figure 19:
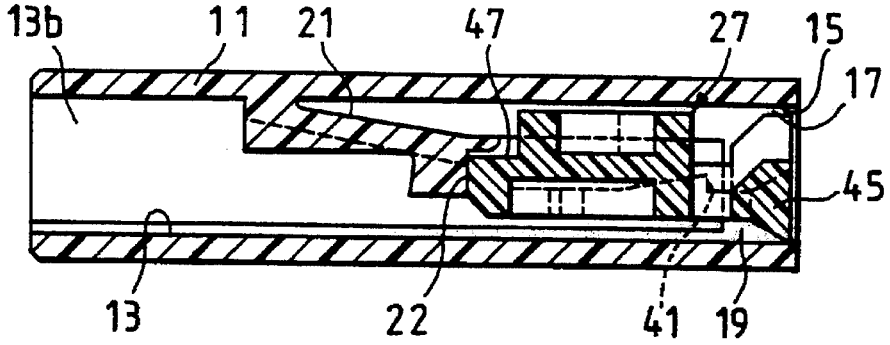
FIG. 19 is a side view taken on line IV—IV of FIG. 18, illustrating the state where the stopping plug has been installed in the terminal receiving chamber which has no terminal hitting preventing wall.
Figure 20:
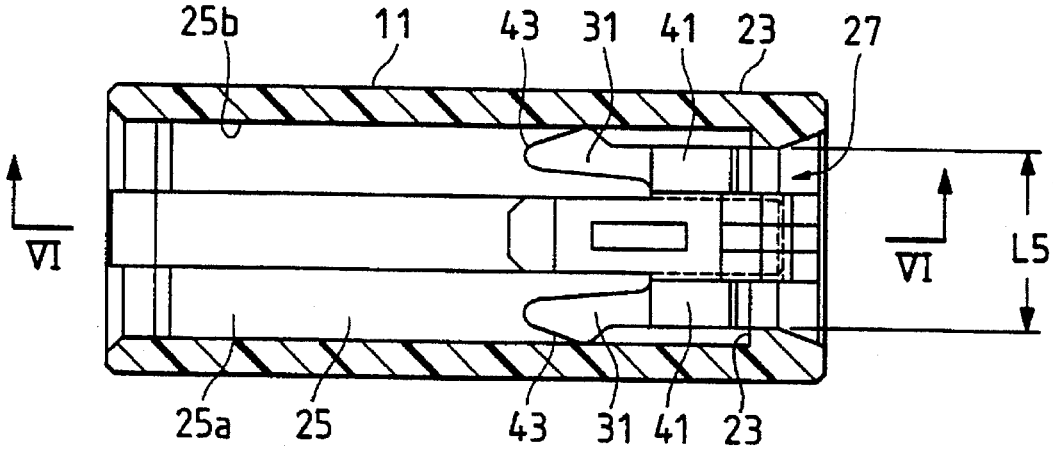
FIG. 20 is a sectional view illustrating the state where a stopping plug has been installed in a terminal receiving chamber which has a terminal hitting preventing wall.
Figure 21:
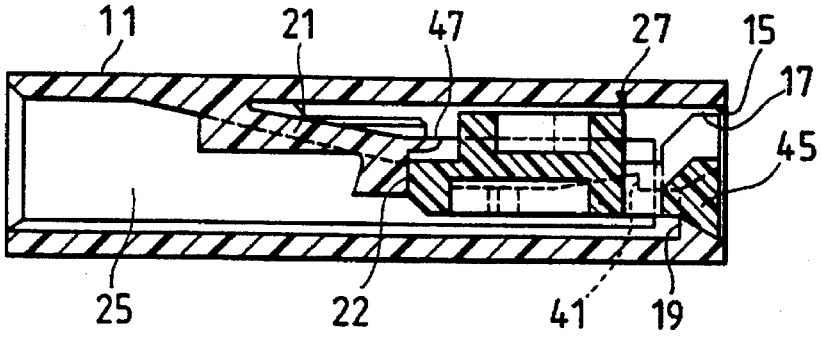
FIG. 21 is a side view taken on line VI—VI of FIG. 20, illustrating the state where the stopping plug has been installed in the terminal receiving chamber which has a terminal hitting preventing wall.
Figure 22A:
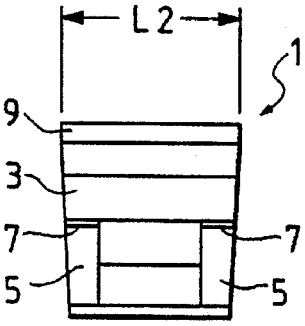
FIG. 22A (PRIOR ART)
Figure 22B:
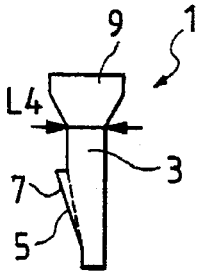
FIG. 22B (PRIOR ART)
Figure 23A:
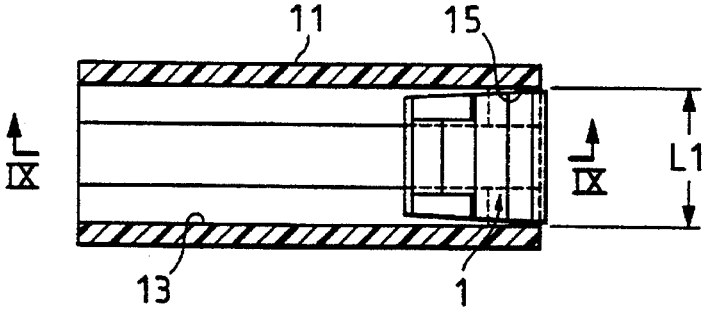
FIG. 23A (PRIOR ART)
Figure 23B:
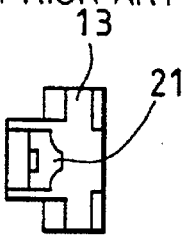
FIG. 23B (PRIOR ART)
Figure 24:
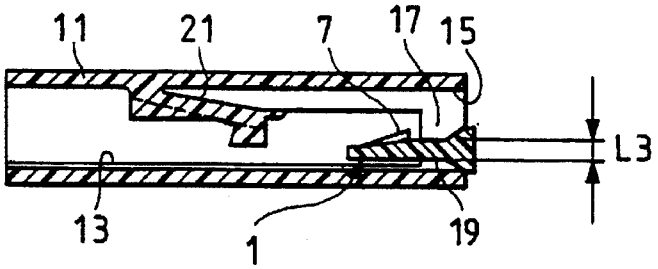
FIG. 24 (PRIOR ART)
FIG. 24 is a sectional view taken on line IX—IX of FIG. 23*a*, illustrating the state where the conventional stopping plug shown in FIGS. 22A and 22B has been installed in the terminal receiving chamber which has no terminal hitting preventing wall.
Figure 25A:
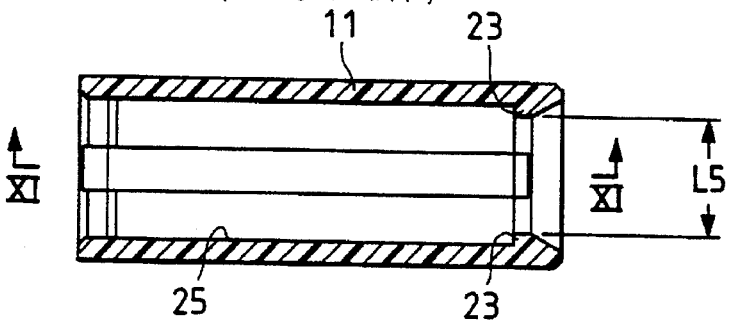
FIG. 25A (PRIOR ART)
Figure 25B:
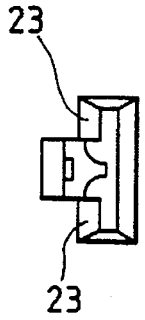
FIG. 25B (PRIOR ART)
Figure 26:
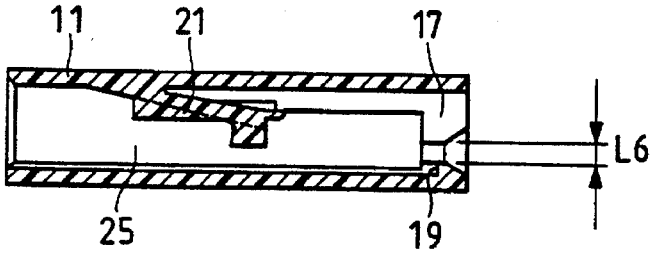
FIG. 26 (PRIOR ART)
FIG. 26 is a sectional view taken on line XI—XI of FIG. 25A, illustrating the inside of the terminal receiving chamber having a terminal hitting preventing wall.

Next, the process of insertion of this stopping plug 27 into the terminal receiving chamber 13 of the connector housing 11 will be described. FIGS. 18 and 19 show the terminal receiving chamber 13 which has no terminal hitting preventing wall, and FIGS. 20 and 21 show the terminal receiving chamber 25 in which a terminal hitting preventing wall 23 is formed. The width L5 of the opening of this terminal receiving chamber 25 is shorter than the distance L7 between the respective outsides of the pair of flexible arms 31 and 31. In addition, the distance between the opposite inner walls 25*a* and 25*b* of the terminal receiving chamber 25 is set to be equal to that between the inner walls 13*a* and 13*b* of the terminal receiving chamber 13.

When the stopping plug 27 is pushed into the opening of the terminal receiving chamber 13, the projections 41 and 41 go over the terminal stopping wall 17 of the opening edge portion of the terminal receiving chamber 13 so as to be engaged therewith, and then the cover portion 45 closes the opening portion 15. At the same time, the abutment wall 47 contacts with the lock wall portion 22 of the flexible lock arm 21 as shown in FIG. 19. In this state, the flexible arms 31 and 31 of the stopping plug 27 touch the opposite inner walls 13*a* and 13*b* of the terminal receiving chamber 13, or have a slight distance therefrom, so that the looseness of the stopping plug 27 in the terminal receiving chamber 13 can be prevented from being formed to the utmost.

Next, in the case where the stopping plug 27 is installed in the terminal receiving chamber 25 shown in FIGS. 20 and 21, even though the terminal hitting preventing wall 23 is disposed in the opening portion of the terminal receiving chamber 25, the flexible arms 31 are bent enough to go over the terminal hitting preventing wall 23, so that the stopping plug 27 can be installed in the terminal receiving chamber 25.

According to this embodiment, since the flexible arms 31 are bent when the stopping plug 27 is inserted into the terminal receiving chamber 13 or 25, the insertion force is reduced so that it is possible to insert the stopping plug 27 easily. It is therefore possible to improve the workability to insert the stopping plug 27 into the terminal receiving chamber 13 or 25 in which no terminal is received. In addition, by adjusting the distance between the flexible arms 31 and 31 and the inner walls 13*a* and 13*b* of the terminal chamber 13, it is possible to install the stopping plug 27 in the terminal chambers 13 or 25 while the looseness in the terminal receiving chamber 13 or 25 is prevented from being formed to the utmost.

In addition, the erroneous connection preventing stopping plug 27 according to this embodiment can be used to different kinds of terminal receiving chambers 13 and 25, so that it is possible to reduce the number of parts, and reduce the manufacturing cost.

Further, the slopes 43 and 43 are formed in the top end portions of the flexible arms 31 of the stopping plug 27 in this embodiment, so that it is possible to insert the stopping plug 27 into the terminal receiving chamber 13 or 25 smoothly. Accordingly, the insertion workability is improved.

As described above, according to the first aspect of the present invention, not only the abutment surfaces formed on rear end of the plug come to abut against the guide slopes of connector housing but also the abutment wall formed on the front end of the plug comes to abut against the lance. Accordingly, the strength against pushing force becomes high so that the stopping plug can not sink down into the connector housing, and the erroneous connection of the connector can be surely prevented from occurring.

According to the second aspect of the present invention, no deviation due to vibration, or the like, is caused so that looseness can be prevented from occurring.

According to the third aspect of the present invention, when the body portion of the stopping plug is inserted into an empty terminal receiving chamber where no terminal is inserted, the pair of flexible arms come to position on the inner walls of the terminal receiving chamber which are opposite to each other, so that the stopping plug can be installed in the empty terminal receiving chamber where no terminal is received in a condition that looseness is suppressed. Further, even in a case where the stopping plug is inserted into a terminal receiving chamber which is narrow in opening width, the stopping plug can be easily inserted if it is inserted in a condition that the flexible arms are elastically bent. Accordingly, the insertion workability can be improved.

According to the fourth aspect of the present invention, if the body portion is pushed into the terminal receiving chamber when the body portion is inserted into the empty terminal receiving chamber where no terminal is received, the slope surfaces of the flexible arms abut against the edges of the opening portions of the terminal receiving chamber so that the flexible arms are easily elastically bent inward. Accordingly, the insertion workability can be improved.

According to the fifth aspect of the present invention, since the distance between the respective outer sides of the pair of flexible arms is set to be larger than the distance between the inner walls in opposition to each other of the terminal receiving chamber, the erroneous connection preventing stopping plug can be received in the terminal receiving chamber without any looseness.

According to the sixth aspect of the present invention, the cover portion closes the opening portion of the terminal receiving chamber when the stopping plug body is inserted into the terminal receiving chamber. Accordingly, a mate-terminal can be prevented from being inserted into an empty terminal receiving chamber where no terminal is received.

According to the seventh aspect of the present invention, when the body portion is inserted into the terminal receiving chamber, the abutment wall comes into contact with the flexible lock arm so that the insertion position is defined. Accordingly, even if the body portion is pushed erroneously by a mate terminal, the body portion is prevented from coming into deeper in the terminal receiving chamber.

What is claimed is:

1. A stopping plug for preventing a mate terminal from being erroneously connected to a useless mate-terminal insertion hole formed in a front wall of a terminal receiving chamber of a connector housing, said stopping plug comprising:

a body portion including:

a central insertion portion having an abutment wall formed on a front end thereof, said central insertion portion positioned at a center of said body portion;

a pair of flexible arms formed on both side of said central insertion portion, said flexible arms including front-half portions which are separated respectively from said central insertion portion so as to have flexibility in a width direction of said body portion, and detachment preventing projections on rear-half portions thereof; and a head portion including abutment surfaces, wherein when said body portion is inserted into the useless mate-terminal insertion hole, the abutment wall of said central insertion portion abuts against a lance formed in the terminal receiving chamber, and the abutment surfaces of said head portion abut against guide slopes formed on a front portion of the mate-terminal insertion hole.

2. The stopping plug of claim 1, wherein each of said flexible arms has a slope surface which is inwardly inclined toward top end portion of said flexible arms.

3. The stopping plug of claim 1, wherein said flexible arms come into slide-contact with inner walls of the terminal receiving chamber.

4. The stopping plug of claim 1, wherein each of the detachment preventing projections include a slope and a lock surface, wherein the detachment preventing projections prevent said body portion from being detached in a direction opposite to the insertion direction of the body portion to the useless mate-terminal insertion hole by abutting the lock surface on a rear surface of the front wall of the terminal receiving chamber.

5. The stopping plug of claim 1, wherein the head portion includes a pair of parallel convex walls extending from one of the abutment surfaces, the convex walls fitting into a rectangular notch formed in one of the guide slopes when the stopping plug in inserted into the mate-terminal insertion hole.

6. The stopping plug of claim 1, wherein a notch portion is formed at an upper portion of the abutment wall, the notch portion receiving a projection of the lance.

7. The stopping plug of claim 1, wherein a width between the rear-half portions of said flexible arms is set to be shorter than a distance between respective outer sides of the front-half portions of said flexible arms.

8. The stopping plug of claim 7, wherein the distance between the respective outer sides of the front-half portions is set to be shorter than a distance between an inner walls in opposition to each other of the terminal receiving chamber.

9. The stopping plug of claim 7, wherein the distance between the respective outer sides of the front-half portions is set to be equal to the distance between an inner walls in opposition to each other of the terminal receiving chamber.

10. The stopping plug of claim 7, wherein the distance between the respective outer sides of the front-half portions is set to be larger than the distance between an inner walls in opposition to each other of the terminal receiving chamber.

11. A structure of a stopping plug and a connector, said structure comprising:

the connector including:

a connector housing having a terminal receiving chamber;

a lance formed inside of the terminal receiving chamber;

a mate-terminal insertion hole formed in a front wall of the terminal receiving chamber; and guide slopes formed in a front portion of the mate-terminal insertion hole;

the stopping plug including:

a body portion;

a central insertion portion having an abutment wall formed on a front end thereof, said central insertion portion positioned at a center of said body portion;

a pair of flexible arms formed on both side of said central insertion portion, said flexible arms including front-half portions which are separated respectively from said central insertion portion so as to have flexibility in a width direction of said body portion, and detachment preventing projections; and a head portion including abutment surfaces, wherein when said body portion is inserted into the mate-terminal insertion hole, the abutment wall of said central insertion portion abuts against the lance in the terminal receiving chamber, and the abutment surfaces of said head portion abut against the guide slopes of the mate-terminal insertion hole.

12. The structure of claim 11, wherein each of said flexible arms has a slope surface which is inwardly inclined toward top end portion of said flexible arms.

13. The structure of claim 11, wherein said flexible arms come into slide-contact with inner walls of the terminal receiving chamber.

14. The structure of claim 11, wherein each of the detachment preventing projections include a slope and a lock surface, wherein the detachment preventing projections prevent said body portion from being detached in a direction opposite to the insertion direction of the body portion to the mate-terminal insertion hole by abutting the lock surface on a rear surface of the front wall of the terminal receiving chamber.

15. The structure of claim 11 wherein the mate-terminal insertion hole includes a rectangular notch formed at the center of one of the guide slopes, and wherein the head portion includes a pair of parallel convex walls extending from one of the abutment surfaces, the convex walls fitting into the rectangular notch when the stopping plug in inserted into the mate-terminal insertion hole.

16. The structure of claim 11, wherein the lance includes a projection extending towards the mate-terminal insertion hole, and wherein a notch portion is formed at an upper portion of the abutment wall, the notch portion receiving the projection of the lance.

17. The structure of claim 11, wherein a width between rear-half portions of said flexible arms is set to be shorter than a distance between respective outer sides of the front-half portions of said flexible arms.

18. The structure of claim 17, wherein the distance between the respective outer sides of the front-half portions is set to be shorter than a distance between an inner walls in opposition to each other of the terminal receiving chamber.

19. The structure of claim 17, wherein the distance between the respective outer sides of the front-half portions is set to be equal to the distance between an inner walls in opposition to each other of the terminal receiving chamber.

20. The structure of claim 17, wherein the distance between the respective outer sides of the front-half portions is set to be larger than the distance between an inner walls in opposition to each other of the terminal receiving chamber.

* * * * *